US005717282A

United States Patent [19]

Oomen et al.

[11] Patent Number: 5,717,282

[45] Date of Patent: Feb. 10, 1998

[54] DISPLAY DEVICE COMPRISING A DISPLAY SCREEN HAVING A LIGHT-ABSORBING COATING

[75] Inventors: Emmanuel W.J.L. Oomen; Daniel Den Engelsen, both of Eindhoven, Netherlands

[73] Assignee: U.S. Philips Corporation, New York, N.Y.

[21] Appl. No.: 602,531

[22] Filed: Feb. 20, 1996

[30] Foreign Application Priority Data

Feb. 20, 1995 [EP] European Pat. Off. ..... 95200402

[51] Int. Cl.[6] ..... H01J 29/88

[52] U.S. Cl. ..... 313/479; 313/478; 313/313

[58] Field of Search ..... 313/478, 313, 313/479, 474, 467, 480, 473, 112

[56] References Cited

U.S. PATENT DOCUMENTS

| | | | |
|---|---|---|---|
| 4,528,477 | 7/1985 | Gallaro | 313/479 |
| 4,987,338 | 1/1991 | Ito et al. | 313/479 X |
| 5,200,667 | 4/1993 | Iwasaki et al. | 313/478 |
| 5,218,268 | 6/1993 | Matsuda et al. | 313/478 |
| 5,248,915 | 9/1993 | Tong et al. | 313/478 |
| 5,291,097 | 3/1994 | Kawamura et al. | 313/479 X |
| 5,315,209 | 5/1994 | Iwasaki | 313/478 |
| 5,520,855 | 5/1996 | Ito et al. | 313/479 X |

FOREIGN PATENT DOCUMENTS

| | | | |
|---|---|---|---|
| 04646937A1 | 1/1992 | European Pat. Off. | H01J 31/12 |
| 0603941A1 | 6/1994 | European Pat. Off. | H01J 29/89 |
| WO9524053 | 9/1995 | WIPO | H01J 29/89 |

*Primary Examiner*—Ashok Patel
*Attorney, Agent, or Firm*—Walter M. Egbert

[57] ABSTRACT

Display device comprising a display screen provided with phosphors, and coated with a spectrally selective, light-absorbing coating comprising silicon oxide and at least two dyes. The spectral transmissions for blue, green and red phosphor light are chosen to be such that the electron currents towards the blue, green and red phosphors for obtaining white D (6,500K) are substantially equal.

15 Claims, 2 Drawing Sheets

DISPLAY DEVICE COMPRISING A DISPLAY SCREEN HAVING A LIGHT-ABSORBING COATING

BACKGROUND OF THE INVENTION

The invention relates to a display device comprising a display screen having an inside surface and an outside surface as well as an electron source for generating electron currents towards a luminescent layer on the inside surface, said layer having a pattern of red, green and blue phosphors, and said outside surface being provided with a light-absorbing coating which comprises silicon oxide and at least two types of dyes having different maximum absorption values.

The invention also relates to a method of manufacturing such a light-absorbing coating on a display screen.

The well-known light-absorbing coatings for reducing light transmission are used on display screens of display devices, such as cathode ray tubes (CRTs), field-emission displays, plasma displays and thin electron displays, to improve the contrast of the image reproduced. By virtue thereof, the necessity of changing the glass composition of the display screen is avoided and the possibilities of bringing the light transmission to a desired value in a simple manner are increased. A distinction is made between transmission or T-coatings, the absorption of which is substantially independent of the wavelength of visible light and which hence are of a neutral-grey colour, and chrominance or C-coatings, which selectively absorb one or more spectral ranges of visible light. In the latter case, the absorption is chosen to be in the spectral range situated between the emission spectra of the phosphors.

In United States Patent document U.S. Pat. No. 5,200,667 a description is given of a chrominance coating on a display screen of a cathode ray tube, which coating comprises a layer of silicon oxide and two or more dyes. Such a coating is manufactured by means of a solution of an alkoxysilane compound and dyes in alcohol, the alkoxysilane compound being converted to silicon oxide by increasing the temperature. In the case of said known coating, the dyes are selected in such a manner that the relevant maximum absorption values are situated between or next to the emission spectra of the blue, green and red phosphors. These phosphors have their maximum emission at wavelengths of 450, 535 and 625 nm, respectively. In the three examples given above, the maximum absorption values of the dyes in the coating are found at wavelengths of 410 and 572 nm; 480 and 580 nm, and 410, 495 and 585 nm. As a result, incident ambient light is partly absorbed, whereas light emanating from the phosphors is passed to the greatest degree possible. By virtue of this measure, the contrast of the colour image is improved.

The well-known display device has the drawback that the electron currents for red, green and blue for producing white light are not equal. As is known, the blue, green and red-luminescing phosphors are provided on the inside surface of the display screen in accordance with a pattern of round or elongated dots, said blue, green and red dots being arranged as triads. Typical phosphors for the emission of blue, green and red light for a cathode ray tube are ZnS:Ag, ZnS:Cu and $Y_2O_2S:Eu^{3+}$, respectively. To obtain white light from such a triad, each dot is activated by an electron current of a specific strength. Each electron current produces an imaging spot on a dot. In display devices, "white" is often defined as "white D", i.e. the colour of a black radiator at a temperature of 6,500K. In the CIE (Commission Internationale d'Éclairage)-colour diagram, "white D" has the coordinates x=0.313 and y=0.329. To obtain "white D", the customary phosphors have different electron currents for red, green and blue. In the case of the above-mentioned phosphors, the nominal electron currents are in the following proportion to each other: 42%, 31% and 27%, respectively. To generate bright white light, higher electron currents are required for each dot, yet in the above-mentioned proportion. This has the disadvantage that the imaging spot of the electron current is much larger for the red dot than for the green and blue dots, resulting in a red edge around the white image. This problem can be overcome by making the dots of the red phosphor larger than those of the green and blue phosphors. However, this soultion leads to landing problems of the electron currents on the red, green and blue phosphors. The use of less efficient green and blue phosphors can also solve the problem, however, it results in a display device having a worse brightness/contrast performance.

In a cathode ray tube, the three electron currents for blue, green and red are generated by three separate electron sources, the so-called guns. A further disadvantage which is encountered in the production of bright "white D" is that the video amplifier driving the "red" gun is overdriven.

SUMMARY OF THE INVENTION

It is an object of the invention to provide, inter alia, a display device in which the nominal electron currents for red, green and blue for obtaining white light D having a colour temperature of 6,500K (colour points x=0.313 and y=0.329 in the CIE colour diagram) are equalized in a simple manner. If said nominal electron currents are equal, the above-mentioned disadvantages will no longer occur. The invention also aims at providing a simple method of manufacturing a coating for a display device.

This object is achieved in accordance with the invention by a display device as described in the opening paragraph, which is characterized according to the invention in that the coating comprises at least two types of dyes of which a maximum absorption value lies between the $\lambda_{50}$-points of a first type of phosphor and a maximum absorption value lies between the $\lambda_{50}$-points of a second type of phosphor, with the $\lambda_{50}$-point representing the wavelength at which the luminous intensity is 50% of the maximum luminous intensity of the phosphor, and the degree of absorption being chosen to be such that the necessary electron currents towards the red, green and blue phosphors are substantially equal to obtain white light having a colour temperature of 6,500 K and coordinates x=0.313 and y=0.329 in the CIE-colour diagram.

In accordance with the invention, the display screen is provided with a coating having such an absorption characteristic that the use of the above-mentioned phosphors will lead to an absorption of blue and green light which exceeds the absorption of red light to such an extent that the nominal electron currents for red, green and blue are substantially equal for reproducing white light D. The electron currents may deviate maximally 3% from the nominal currents. In the case of the above-mentioned phosphors, there should be a slightly stronger absorption of blue light than of green light. For such a coating the following relationship applies:

$$T_{450}<T_{535}<T_{625},$$

wherein $T_{450}$, $T_{535}$ and $T_{625}$ are the transmissions at wavelengths of 450, 535 and 625 nm, respectively. At said wavelengths, the luminous intensities of the above-mentioned blue, green and red phosphors are maximal. In the above example, hardly any absorption takes place in the red wavelength range.

When phosphors other than those mentioned above are used, the degree of absorption in the red, green and blue wavelength ranges must be adapted, so that for example mainly blue and red light or mainly green and red light are absorbed by the coating. In general, the colour (phosphor) requiring the smallest electron current should be absorbed most strongly.

For the above-mentioned blue phosphor (ZnS:Ag), the $\lambda_{50}$-points are at 425 and 480 nm. For the green (ZnS:Cu) and red phosphors ($Y_2O_2S:Eu^{3+}$) said $\lambda_{50}$-points are at 510, 580 nm and 620, 630 nm, respectively.

The degree of absorption of the coating is governed by the type of dye provided in the coating, the concentration of said dye and the thickness of the coating.

The above-mentioned U.S. Pat. No. 5,200,667 does not offer a solution regarding the equalization of the electron currents for red, green and blue. In said Patent document, the maximum absorption values of the dyes in the coating are chosen to be between the wavelengths at which the phosphors exhibit maximum luminescence, i.e. between for example the long-wave $\lambda_{50}$-point of the blue phosphor and the short-wave $\lambda_{50}$-point of the green phosphor and/or between the long-wave $\lambda_{50}$-point of the green phosphor and the short-wave $\lambda_{50}$-point of the red phosphor. The light output of the phosphors through the coating is influenced as little as possible, so that the electron currents towards the various types of phosphors are different.

The matrix of the coating comprises an inorganic network of silicon oxide, which is preferably obtained by means of a sol-gel process which will be discussed in greater detail hereinbelow. By means of such a process, a layer thickness of maximally, approximately 0.5 μm can be attained. Layers having a maximum thickness of more than 10 μm can be manufactured from a hybrid inorganic-organic material, also by means of a sol-gel process. Apart from an inorganic network of silicon oxide, such a material comprises an inorganic polymer which is bonded to the inorganic network via Si—C bonds. The polymeric chains are intertwined with the inorganic network and form a hybrid inorganic-organic network with said inorganic network. The chemical bonds between the polymeric component and the inorganic network result in mechanically robust and thermally stable coatings. By virtue of said polymeric component in the inorganic network, coatings having a thickness in excess of 10 μm can be manufactured without the formation of cracks (crackle) in the layer. In such relatively thick coatings a comparatively large quantity of dye can be dissolved or incorporated, so that the light absorption of the coatings can be relatively high. In addition, when such relatively thick coatings are used, it is not necessary to subject the glass surface of the display screen to a time-consuming fine-polishing treatment, for example, with $Ce_2O_3$.

The dyes to be used should, inter alia, be soluble in the process liquid used in the sol-gel process. Moreover, in the coating, said dyes should be sufficiently resistant to light and, for example, to ethanol and water.

Suitable dyes which absorb in the blue wavelength range are, for example, the following yellow azo-dyes:

Zapon Gelb 100 (S.Y. 32; C.I. 48045), supplier BASF;
Zapon Gelb 141 (S.Y. 81; C.I. 13900:1), supplier BASF;
Zapon Orange 244 (S.O. 5; C.I. 18745: 1), supplier BASF;
Orasol Gelb 2 GLN (S.Y. 88) supplier Ciba.

Suitable dyes which absorb in the red wavelength range are the blue phthalocyanine dyes:

Zapon Blau 806 (S.B. 25; C.I. 74350), supplier BASF;
Neptun Blau 722 (S.B. 38; C.I. 74180), supplier BASF;
Orasol Blau GN (S.B. 67), supplier Ciba; and the anthraquinone dyes:
Savinyl Blau RS (S.B. 45), supplier Sandoz;
Filamid Blue R (S.B. 132), supplier Ciba;
Oracet Blue 2R (S.B. 68; C.I. 61110), supplier Ciba;
Remozal brillant blue R (A.B. 80; C.I. 61585), supplier Aldrich.

Suitable dyes which absorb in the green wavelength range are xanthene dyes, such as Rhodamine B (S.R. 49; C.I. 45170), supplier Merck. Another suitable dye is Zapon Violet 506 (S.V. 2), supplier BASF, a combination of a mono-azo and a xanthene dye. In particular the latter dye is very suitable due to its high light resistance. In the above, the dyes are indicated with their generic Colour Index (C.I.) name and, as far as is known, with their Colour Index number.

Although inorganic pigments are very light-fast, they are not very suitable for such coatings because the light diffusion of the layer increases when larger particles are used and the extinction coefficients are a factor of 100 to 10,000 lower than those of organic dyes. In view of the small layer thickness of the coating, the absorption of the layer will often be insufficient.

In a suitable embodiment, the coating on a display screen of a cathode ray tube, which display screen is provided with the above-mentioned phosphors, comprises the following dyes: Rhodamine B (S.R. 49; C.I. 45170), Zapon Gelb 100 (S.Y. 32; C.I. 48045) and Orasol Blau GN (S.B. 67). Rhodamine B has a maximum absorption value at 560 nm and hence absorbs light which is emitted by the green phosphor. Zapon Gelb 100 has a maximum absorption value (plateau) between 400 and 435 nm and absorbs light which is emitted by the blue phosphor. Orasol Blau GN has its maximum absorption value around 625 and 672 nm and absorbs light which is emitted by the red phosphor.

The coating in accordance with the invention can be applied to display screens of cathode ray tubes in which the electron currents are generated by one or more electron guns. The coating can also be used on display screens of thin electron displays, as described in EP-A-464937, in the name of the current applicant, in which the electron currents originate from a wire-shaped cathode and reach the phosphor layer via selection plates. The coating can further be used on display screens of field-emission displays and plasma displays. The various display devices comprise, on the inside of the display screen, phosphors which may be of a different type than those of cathode ray tubes. To obtain the desired colour white D, the dyes and/or concentrations thereof in the coating must be adapted.

To obtain electrical conduction and hence antistatic properties, conductive metal oxides such as tin oxide, indium oxide, antimony oxide and mixtures of these oxides can be incorporated in the coating. Also conductive polymers such as polypyrrole and poly-3,4-ethylene dioxythiophene can be used.

The coating in accordance with the invention can be combined with a second coating having a neutral (grey) character to improve the contrast. This second layer can also be obtained by means of a sol-gel process, said layer containing one or more of the black dyes described in European Patent Application EP-A-603941, in the name of the current applicant.

The object of providing a method of manufacturing a spectrally, selectively absorbing coating on a display screen of a display device as described hereinabove is achieved by a sol-gel process which is known per se and in which alkoxysilane compounds are used as the starting materials, which method is characterized in accordance with the invention in that a type of dye is selected whose maximum absorption value lies between the $\lambda_{50}$-points of a first type of phosphor, and a type of dye is selected whose maximum absorption value lies between the $\lambda_{50}$-points of a second type of phosphor, the $\lambda_{50}$-point representing the wavelength at which the luminous intensity is 50% of the maximum luminous intensity of the phosphor, and the degree of absorption being chosen to be such that the necessary electron currents towards the red, green and blue phosphors are substantially equal to obtain white light having a colour temperature of 6,500 K and coordinates x=0.313 and y=0.329 in the CIE-colour diagram.

The reason for choosing said types of dyes has already been explained hereinabove.

A suitable alkoxysilane compound for use in the method in accordance with the invention is tetraethyl orthosilicate TEOS). Also other known alkoxysilane compounds of the type $Si(OR)_4$ and oligomers thereof can be used, wherein R is an alkyl group, preferably a $C_1$–$C_5$ alkyl group.

A quantity of 2–15 mol % oxide of Ge, Zr, Al or Ti, or a mixture of one or more of these metal oxides, is incorporated in silicon oxide if desired. This increases the resistance of the coating against leaching of the dyes by customary solvents such as ethanol and water. In addition, germanium oxide improves the light fastness of some dyes. Said oxides can be incorporated in the coating by providing the coating solution with the corresponding metal alkoxides, such as tetraethyl orthogermanate $Ge(OC_2H_5)_4$ (TEOG), tetrabutyl orthozirconate $Zr(OC_4H_9)_4$ (TBOZ), tetrapropyl orthozirconate $Zr(OC_3H_7)_4$ (TPOZ), tripropyl orthoaiuminate $Al(OC_3H_7)_3$ (TPOAI) and tetraethyl orthotitanate $Ti(OC_2H_5)_4$ (TEOTi).

As the solvent for the solution of the alkoxysilane compound, the dyes and any metal alkoxides, use is made of water or an alcohol, such as methanol, ethanol, propanol or butanol. The solution is acidified, for example, with diluted hydrochloric acid.

The conversion to silicon oxide takes place by means of a treatment at a temperature ranging between 150° and 170° C. for at least 30 minutes. At said relatively low temperatures, all the parts of a display device remain undamaged. The alkoxy groups of the alkoxysilane compound are converted to hydroxy groups by acidified water, said hydroxy groups reacting with each other and with hydroxy groups at the glass surface of the display screen. During drying and heating, a network of silicon oxide having satisfactory bonding properties is formed by polycondensation.

The alkoxysilane solution can be provided on the display screen by spraying, atomizing or dip coating. The alkoxysilane solution is preferably provided on the display screen by spin coating. Said latter method results in a smooth, uniform coating.

By means of the above-mentioned sol-gel method, coatings having a thickness of maximally, approximately 0.5 μm can be manufactured owing to the large quantities of water and alcohol to be vaporized and the shrinkage which takes place during curing. As a result, the risk of cracks forming in the layer increases as the layer thickness increases.

If larger layer thicknesses are desired, a hybrid inorganic-organic material can be used as the matrix for the coating. Such a coating, which is used as a C- or T-coating, is described in the non-prepublished International Patent Application WO 95/24053, in the name of the current applicant. The material for a coating described therein does not only comprise the inorganic network of silicon oxide but also a polymeric component. Specific C-atoms of the polymer are chemically bonded to Si-atoms of the inorganic network. The polymeric chains are intertwined with the inorganic network and form a hybrid inorganic-organic network with said inorganic network. The chemical bond between the polymeric component and the inorganic network results in mechanically robust and thermally stable coatings. The polymeric component in the silicon-oxide network enables thick coatings in excess of 10 μm to be manufactured without cracks forming in the layer. In such relatively thick layers, a relatively large quantity of a dye can be incorporated or dissolved, if necessary, to obtain the desired absorption.

Coatings of a hybrid inorganic-organic material can alternatively be manufactured by a sol-gel process. In this case, the coating solution comprises a triakoxysilane having the formula:

$$(RO)_3\,Si{-}R^1$$

wherein R is a $C_1$–$C_5$ alkyl group and $R^1$ is a polymerizable group, and $R^1$ is chemically bonded to the Si-atom via an Si—C bond, dyes, a solvent and, optionally, an alkoxy compound of Al, Ti, Zr or Ge. A thermal treatment results in the formation of an inorganic network and a polymer of the polymerizable group $R^1$. Examples of suitable polymerizable groups $R^1$ are the epoxy, methacryloxy and vinyl groups. An example of a trialkoxysilane comprising an epoxy group is 3-glycidoxy propyl-trimethoxysilane. The epoxy groups can be thermally polymerized to form a polyether, for which purpose an amine compound, such as 3-aminopropyl-triethoxysilane, may optionally be added to the solution as a catalyst.

Apart from water for the hydrolysis reaction, the solution comprises one or more organic solvents such as ethanol, butanol, isopropanol and diacetone alcohol.

To improve the chemical resistance of the coating, the coating solution may optionally comprise trialkoxysilanes containing non-polymerizable groups such as an alkyl trialkoxysilane or aryl trialkoxysilane.

These and other aspects of the invention will be apparent from and elucidated with reference to the embodiments described hereinafter.

DETAILED DESCRIPTION OF THE PREFERRED EMBODIMENTS

Figure 1:
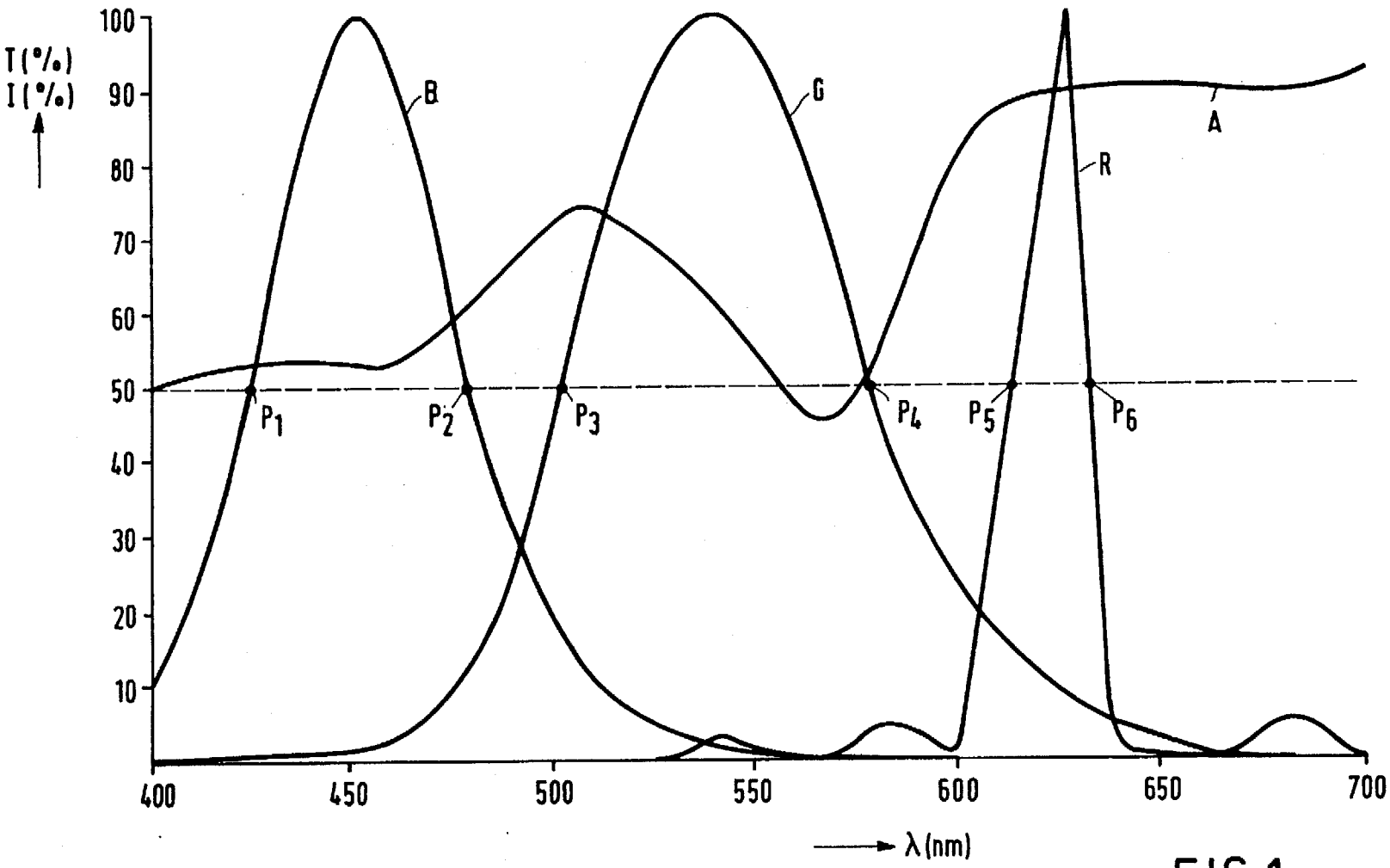
FIG. 1 shows the transmission T (in %) as a function of the wavelength λ (in nm) of a spectrally selective coating in accordance with the invention as well as the emission spectra of customary blue, green and red phosphors of a cathode ray tube.

Exemplary embodiment 1.

A coating solution having the following composition is prepared:

10 g tetraethyl orthosilicate (TEOS)
50 g ethanol
30 g butanol 10 g water acidifed with 0.1 mol/l HCl
300 mg Rhodamine B (S.R 49; C.I. 45170), supplier Merck
1.5 g Zapon Gelb 100 (S.Y. 32; C.I. 48045), supplier BASF
150 mg Orasol Blau GN (S.B. 67), supplier Ciba.

The components are stirred at room temperature for 1 day and then passed through a 0.5 μm filter.

Of the solution obtained a quantity of 50 ml is spin coated on to a rotating display screen having a diagonal of 74 cm (29 inches) at 400 revolutions per minute. The layer thus obtained is cured for 30 minutes at 150° C. The coating obtained has a thickness of 400 nm (0.4 μm).

Curve A in FIG. 1 shows the transmission T (in %) of the coating, as a function of the wavelength λ (in nm). Said Figure also shows the curves B, G and R of the relative luminous intensities I (in %) of the customary blue (ZnS:Ag), green (ZnS:Cu) and red ($Y_2O_2S:Eu^{3+}$) phosphors, respectively, of cathode ray tubes. The blue phosphor has a maximum luminous intensity at 450 nm; the green phosphor at 535 nm and the red phosphor at 625 nm. The $\lambda_{50}$-points, where the intensities are 50% of the maximum intensities, are at 425 and 480 nm ($P_1$ and $P_2$) for the blue phosphor; at 510 and 580 nm ($P_3$ and $P_4$) for the green phosphor and at 610 and 630 nm ($P_5$ and $P_6$) for the red phosphor. The coating has its maximum absorption values between the $\lambda_{50}$-points of the blue and green phosphors and exhibits an avenge transmission of 53% for blue phosphor light, 60% for green phosphor light and 90% for red phosphor light. The electron currents for the blue, green and red phosphors for obtaining white D (colour temperature 6,500K; see below) are equal now. By virtue thereof, the imaging spots of large electron currents for blue, green and red are equal, so that a coloured (in this case red) edge around a bright, white imaging spot is precluded.

Figure 2:
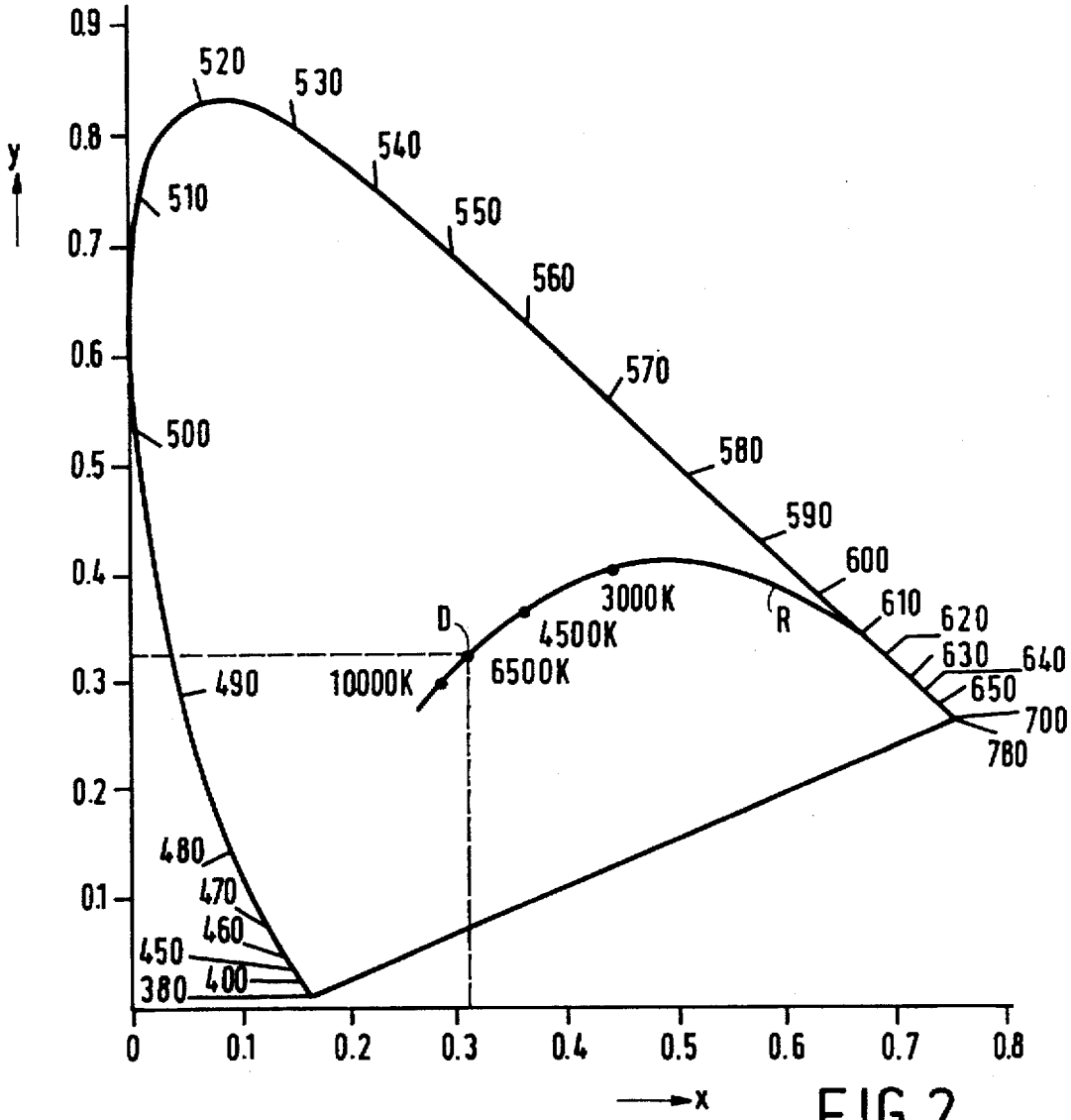
FIG. 2 shows the CIE-colour diagram in which the position of "white D" is indicated.

FIG. 2 shows a standard CIF-colour diagram. The wavelengths of the saturated colours extend along a horseshoe-shaped line in the range between 380 and 780 nm. Each colour along said line and within the area formed by this line can be represented by means of x- and y-coordinates. The line R represents the spectrum of a black radiator as a function of the temperature in K. White D is the colour of a black radiator having a temperature of 6,500 K and coordinates x=0.313 and y=0.329.

Exemplary embodiment 2.

Figure 3:
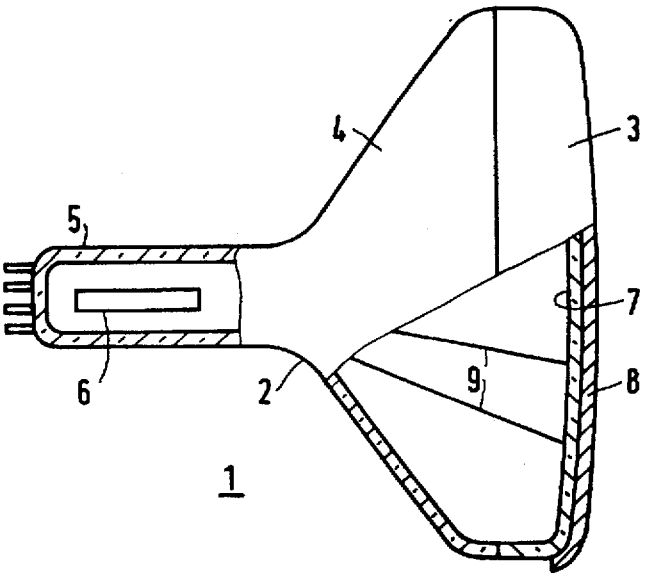
FIG. 3 is a partly cut-away view of a cathode ray tube having a coating in accordance with the invention.

FIG. 3 schematically shows a cut-away view of a cathode ray tube 1 with a glass envelope 2, which is known per se, said cathode ray tube comprising a display screen 3, a cone 4 and a neck 5. Said neck accommodates one or three electron guns 6 for generating electron currents in the form of electron beams 9. These electron beams 9 are focused on a phosphor layer (not shown) having blue, green and red phosphors on the inside 7 of the display screen 3. The electron beams 9 are deflected across the display screen 3 in two mutually perpendicular directions by means of a deflection coil system (not shown). The display screen 3 is provided on the outside with a light-absorbing, spectally selective coating 8 in accordance with the invention.

By means of a coating on a display screen of a display device in accordance with the invention, the electron currents for the blue, green and red phosphors are equalized in a simple manner. By virtue thereof, the imaging spots, particularly of large electron currents for blue, green and red are equal, so that a red edge around a bright white image is precluded.

What is claimed is:

1. A display device comprising:

a display screen having an inside surface, an outside surface, a luminescent layer on the inside surface, and an electron source for generating electron currents associated with the luminescent layer, said luminescent layer having a pattern of a plurality of phosphors comprising ZnS:Ag, ZnS:Cu, and $Y_2O_2S:Eu^{3+}$;

a light-absorbing coating formed on said outside surface and comprising at least two dyes selected from a group consisting of a blue phthalocyanine dye having a maximum absorption value in a range of 620–630 nm, a yellow azo-dye having a maximum absorption value in a range of 425–480 nm, and a xanthene dye having a maximum absorption value in a range of 510–580 nm, a first of said maximum absorption values lying between the $\lambda_{50}$-points of a first of said plurality of phosphors and a second of said maximum absorption values lying between the $\lambda_{50}$-points of a second phosphor; and wherein the degree of absorption is such that the electron currents respectively associated with said phosphors are substantially equal.

2. The display device of claim 1, wherein the pattern is of red, green and blue phosphors and the maximum absorption value of one dye lies between the $\lambda_{50}$-points of the blue phosphor and the maximum absorption value of another dye lies between the $\lambda_{50}$-points of the green phosphor.

3. The display device of claim 2, wherein, for the coating, the following relationship applies:

$$T_{450}<T_{535}<T_{625},$$

wherein $T_{450}$, $T_{535}$ and $T_{625}$ are the transmission values at wavelengths of 450, 535 and 625 nm, respectively.

4. The display device of claim 3, wherein the coating comprises the following dyes: Rhodamine B (colour Index S.R. 49-45170), Zapon Gelb 100 (Colour Index S.Y. 32-48045) and Orasol Blau GN (Colour Index S.B. 67).

5. The display device of claim 1, wherein the device comprises one of a cathode ray tube, a thin electron display, a field emission display and a plasma display.

6. The display device of claim 1, wherein the dyes are selected, and the coating formed, such that the electron currents are substantially equal in obtaining white light having a colour temperature of 6,500K and coordinates x=0.313 and y=0.329 in the CIE-colour diagram.

7. The display device of claim 6, wherein the pattern is of red, green and blue phosphors and the maximum absorption value of one dye lies between the $\lambda_{50}$-points of the blue phosphor and the maximum absorption value of another dye lies between the $\lambda_{50}$-points of the green phosphor.

8. The display device of claim 7, wherein, for the coating, the following relationship applies:

$$T_{450}<T_{535}<T_{625},$$

wherein $T_{450}$, $T_{535}$ and $T_{625}$ are the transmission values at wavelengths of 450, 535 and 625 nm, respectively.

9. The display device of claim 8, wherein the phosphors are selected so that, at said wavelengths, the luminous intensities of the phosphors are substantially maximal.

10. The display device of claim 9, wherein the coating comprises the following dyes: Rhodamine C (colour Index S.R. 49-45170), Zapon Gelb 100 (Colour Index S.Y. 32-48045) and Orasol Blau GN (Colour Index S.B. 67).

11. The display device of claim 9, wherein the yellow-azo dye for absorbing in the blue wavelength range is one selected from the group consisting of:

Zapon Gelb 100 (S.Y. 32; C.I. 48045),

Zapon Gelb 141 (S.Y. 81; C.I. 13900:1),

Zapon Orange 244 (S.O. 5; C.I. 18745:1), and

Orasol Gelb 2 GLN (S.Y. 88)

and the blue phthalocyanine dye for absorbing in the red wavelength range is one selected from the group consisting of:

Zapon Blau 806 (S.B. 25; C.I. 74350),

Neptun Blau 722 (S.B. 38; C.I. 74180),

Orasol Blau GN (S.B. 67); and the anthraquinone dyes:

Savinyl Blau RS (S.B. 4),

Filamid Blue R (S.B. 132),

Oracet Blue 2R (S.B. 68; C.I. 61585), and

Remozal brilliant blue R (A.B. 80; C.I. 61585)

and the xanthene dye for absorbing in the green wavelength range is one selected from the group consisting of Rhodamine B (S.R. 49; C.I. 45170) and Zapon Violet 506 (s.v. 2).

12. The display device of claim 1, wherein the dyes are selected and the coating formed so as to adapt the degree of absorption in each of the red, green and blue wavelength ranges so that, for a selected luminous intensity, the phosphor requiring the smallest electron current is absorbed most strongly, the phosphor requiring greatest electron current is absorbed least strongly and a phosphor requiring an intermediate electron current is absorbed to an immediate degree.

13. The display device of claim 1, wherein the coating comprises silicon dioxide.

14. The display device of claim 1, wherein the coating comprises an inorganic polymer bonded to an inorganic network and in which dye is dissolved or incorporated.

15. A display device comprising:

a display screen having an inside surface, an outside surface, a luminescent layer on the inside surface, and an electron source for generating electron currents associated with the luminescent layer, said luminescent layer having a pattern of blue, green and red phosphors comprising ZnS:Ag, ZnS:Cu, and $Y_2O_2S:Eu^{3+}$, respectively;

a light-absorbing coating formed on said outside surface and comprising at least two dyes selected from a group consisting of Rhodamine B (colour index S.R. 49-45170) having a maximum absorption value at 560 nm, Zepon Gelb 100 (colour index S.Y. 32-48045) having a maximum absorption value between 400 and 435 nm, and Orasol Blau GN (colour index S.B. 67) having a maximum absorption value at 625 nm and 672 nm, a first of said maximum absorption values lying between the $\lambda_{50}$-points of the blue phosphor and a second of said maximum absorption values lying between the $\lambda_{50}$-points of the green phosphor, said coating having the following relationship:

$$T_{450}<T_{535}<T_{625},$$

wherein $T_{450}$, $T_{535}$, and $T_{625}$ are the transmission values at wavelengths 450, 535, and 635 nm, respectively; and wherein the degree of absorption is such that the electron currents respectively associated with said phosphors are substantially equal.

* * * * *